US010300702B2

(12) United States Patent
Lebron et al.

(10) Patent No.: US 10,300,702 B2
(45) Date of Patent: May 28, 2019

(54) PRINTING FLUID CONTAINER

(71) Applicant: Hewlett-Packard Development Company, L.P., Houston, TX (US)

(72) Inventors: Hector Lebron, San Diego, CA (US); Jose A. de la Rosa, Isabela, PR (US); Luis E. Rodriguez, Mayaguez, PR (US); Juan A. Marrero, Aguadilla, PR (US); Eladia Velez, Moca, PR (US)

( * ) Notice: Subject to any disclaimer, the term of this patent is extended or adjusted under 35 U.S.C. 154(b) by 0 days.

(21) Appl. No.: 15/565,861

(22) PCT Filed: Jul. 22, 2015

(86) PCT No.: PCT/US2015/041630

§ 371 (c)(1),
(2) Date: Oct. 11, 2017

(87) PCT Pub. No.: WO2017/014779

PCT Pub. Date: Jan. 26, 2017

(65) Prior Publication Data

US 2018/0117918 A1 May 3, 2018

(51) Int. Cl.
*B41J 2/175* (2006.01)

(52) U.S. Cl.
CPC ..... *B41J 2/17523* (2013.01); *B41J 2/175* (2013.01); *B41J 2/17513* (2013.01); *B41J 2/17553* (2013.01); *B41J 2002/17516* (2013.01)

(58) Field of Classification Search
USPC ..... 347/86
See application file for complete search history.

(56) References Cited

U.S. PATENT DOCUMENTS

| | | | |
|---|---|---|---|
| 4,568,954 | A | 2/1986 | Rosback |
| 5,745,137 | A | 4/1998 | Scheffefin et al. |
| 6,017,118 | A | 1/2000 | Gasvoda et al. |
| 6,164,743 | A | 12/2000 | Hmelar et al. |
| 6,264,314 | B1 | 7/2001 | Mochtzuki et al. |
| 6,296,353 | B1 | 10/2001 | Thielman et al. |
| 6,709,093 | B2 | 3/2004 | Perkins et al. |
| 7,926,925 | B2 | 4/2011 | Ikezaki |
| 8,220,909 | B2 | 7/2012 | Domae |
| 8,454,143 | B2 | 6/2013 | Takeuchi |
| 8,474,655 | B2 | 7/2013 | Hackleman et al. |
| 2003/0202062 | A1 | 10/2003 | Steinmetz et al. |
| 2011/0279588 | A1 | 11/2011 | Fascio |

FOREIGN PATENT DOCUMENTS

JP 2005059874 3/2005

OTHER PUBLICATIONS

"Development of the HP DeskJet 1200C Print Cartridge Platform", Hewlett-Packard Journal, Feb. 1994 , 9 pages.
International Search Report and Written Opinion for International Application No. PCT/US2015/041630 dated Mar. 31, 2016, 21 pages.

*Primary Examiner* — Lam S Nguyen
(74) *Attorney, Agent, or Firm* — Dierker & Kavanaugh PC

(57) ABSTRACT

In one example, a container includes a rigid hollow core, a bag in the core to hold a printing fluid, and a plug plugging one end of the core. The plug includes a flange covering the edge of the end of the core, a part protruding from the flange into and plugging the end of the core, and a port operatively connected to an outlet from the bag such that printing fluid can flow out of the bag and through the port.

8 Claims, 10 Drawing Sheets

PRINTING FLUID CONTAINER

BACKGROUND

In some higher volume commercial and industrial inkjet printers, inks and other printing fluids are supplied to the printheads from collapsible bags. Ink supply bags may be supported in a box or other housing at a location remote from the printheads.

DRAWINGS

The same part numbers designate the same or similar parts throughout the figures. The figures are not necessarily to scale.

DESCRIPTION

A new container for ink and other printing fluids has been developed to help improve scalability and reduce cost, particularly for higher volume inkjet printers. In one example, the container includes a rigid hollow core and a bag in the core to hold the printing fluid. One end of the core is plugged and the other end capped to contain the bag. The plug provides the fluid and mechanical connections to the printer. The plug is sized and shaped to fit securely within the core. Barbs may be formed along the outer perimeter of the plug to help secure the plug in the core. In one example, inexpensive molded plastic plugs and caps are used with fiberboard cores to help reduce cost. The capacity of a container may be changed by varying the length of the core without changing either the plug or the cap. Thus, containers may be scaled up or down while maintaining a constant footprint at the printer interface, enabling greater versatility for integration into printer designs in which footprint space is constrained.

The examples shown in the figures and described herein illustrate but do not limit the scope of the patent, which is defined in the Claims following this Description.

As used in this document, a "bag" means a container with a collapsible interior volume; "fiberboard" means an engineered wood product made with wood pulp and/or wood fibers and includes (but is not limited to) paperboard, particle board, and hardboard; the "footprint" of a container means the projection of an outside perimeter of the container; and a "printing fluid" means a fluid that may be dispensed by an inkjet printer or other inkjet type dispenser.

Figure 1:
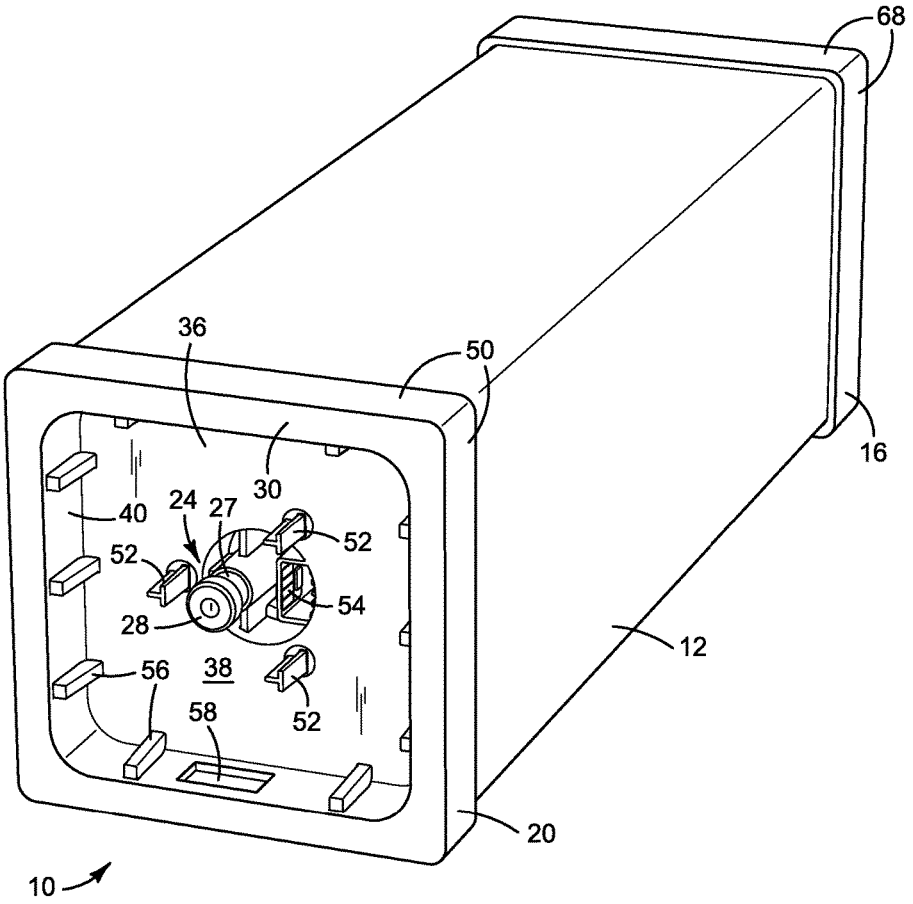
FIG. 1 is an isometric illustrating one example of a container to hold ink or other printing fluid.
Figure 2:
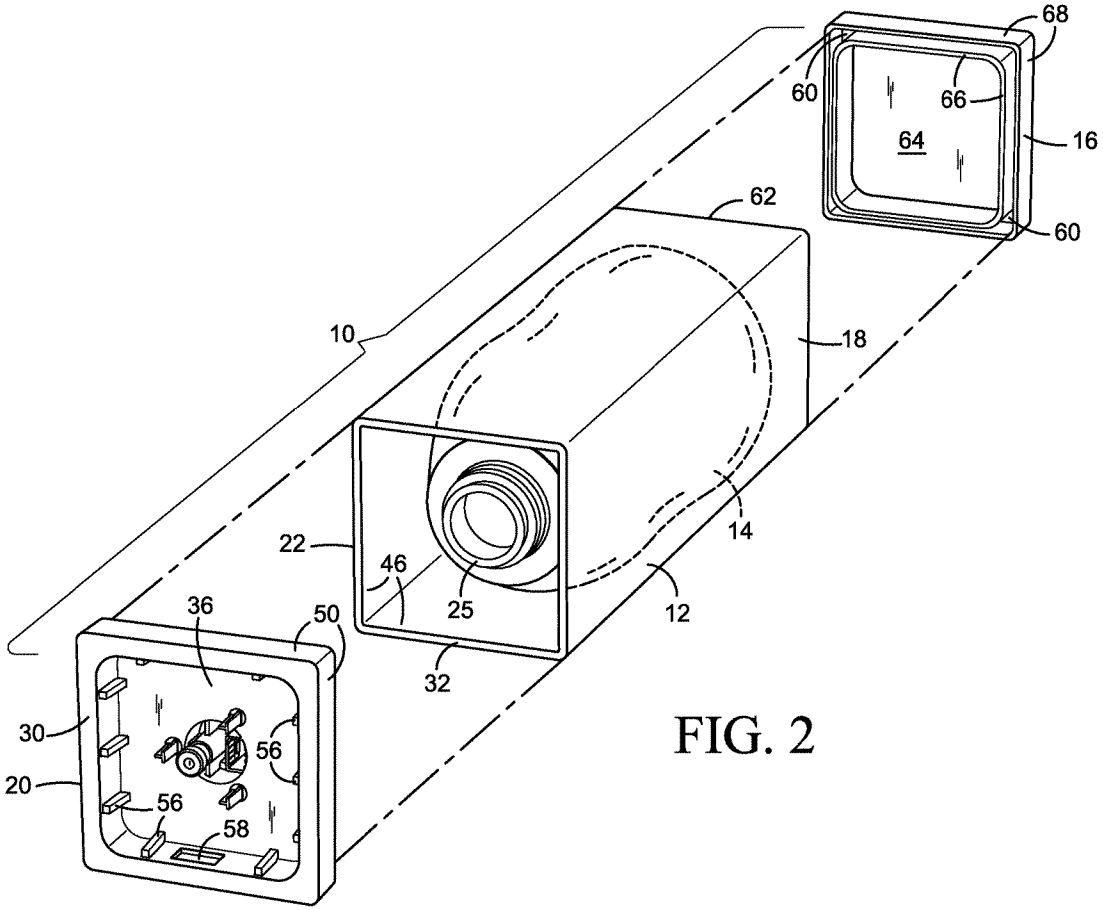
FIG. 2 is an exploded isometric of the example container shown in FIG. 1.

FIG. 1 illustrates one example of a container 10 to hold printing fluid. FIG. 2 is an exploded view of container 10 shown in FIG. 1. Referring to FIGS. 1 and 2, container 10 includes a hollow core 12 and a bag 14 in core 12 to hold printing fluid. Container 10 also includes a cap 16 capping one end 18 of core 12 and a plug 20 plugging the other end 22 of core 12. Plug 20 is sometimes referred to herein as an "interface" plug because it includes features to interface with the printer. In this example, core 12 is configured as a rigid tube having a rectangular cross section that extends uniformly from one end 18 to the other end 22. Other core configurations are possible. For example, core 12 may have a round or other curvilinear cross section.

Figure 3:
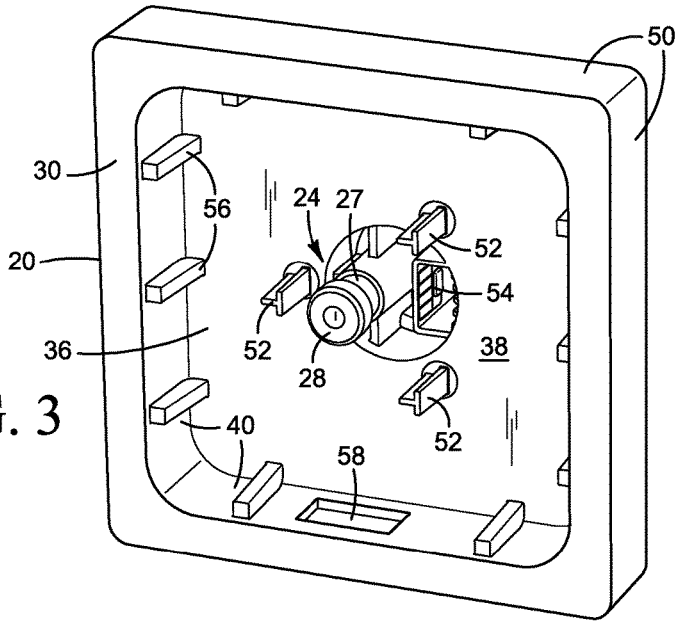
FIGS. 3 and 4 are front side and back side isometrics, respectively, illustrating one example of an end plug in the container shown in FIGS. 1 and 2.
Figure 4:
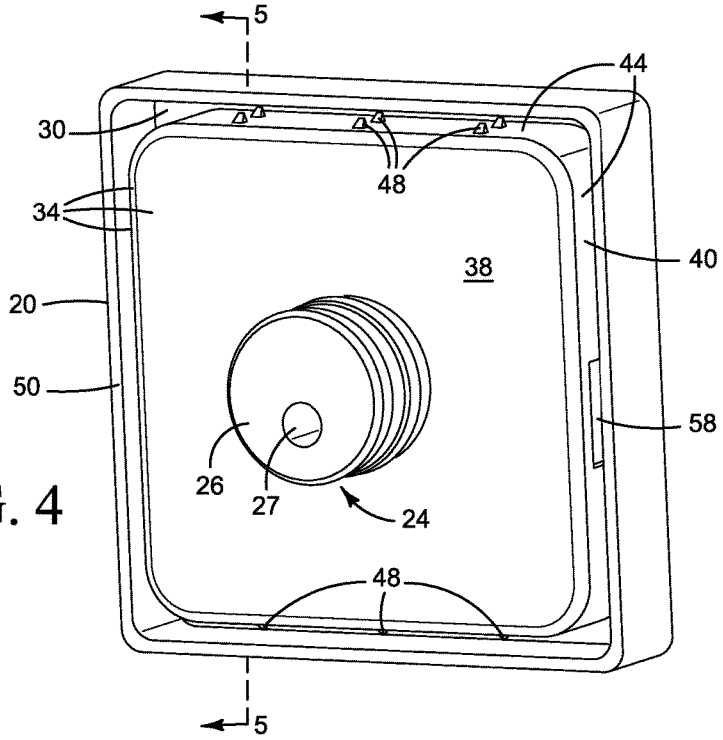
Figure 5:
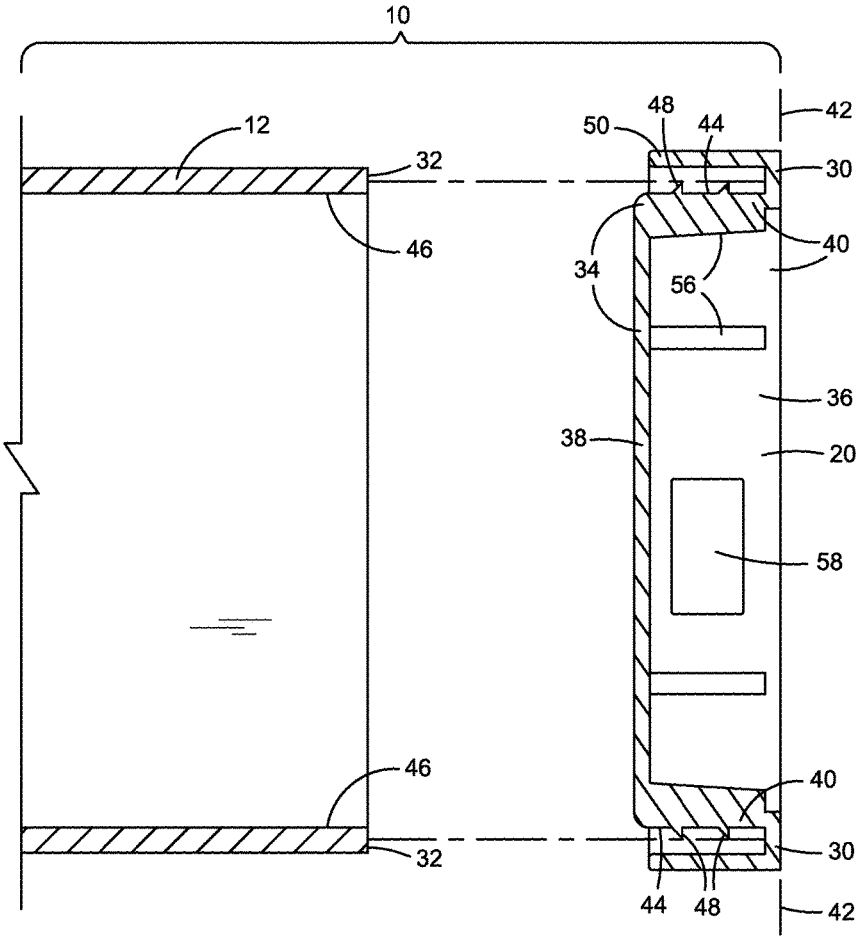
FIG. 5 is a section of the example plug shown in FIGS. 3 and 4, taken along the line 5-5 in FIG. 4.

Referring now also to the detail views of FIGS. 3-5, plug 20 includes a port 24 operatively connected to an outlet 25 from bag 14 such that printing fluid can flow out of bag 14 and through port 24. In this example, bag outlet 25 is configured as a spout and port 24 includes a fitting 26 that protrudes from the back side of plug 20 into spout 25, a conduit 27, and a septum or other suitable valve 28 to connect conduit 27 to downstream components that carry fluid to the printheads or other printing elements of a printer. Plug 20 includes a flange 30 covering the edge 32 of the end 22 of core 12 and a part 34 protruding from flange 30 to plug core 12. Plugging part 34 forms a recess 36 defined by a floor 38 and a perimeter wall 40 that extends between floor 38 and flange 30. Recess 36 provides a region behind the plane 42 of flange 30 surrounded by wall 40 to help protect port 24 and other connecting features of container 10.

As best seen in FIG. 5, the outer perimeter 44 of each plugging part 34 is about the same size as the inner perimeter 46 of the end 22 of core 12. In the example shown, barbs 48 on plug outer perimeter 44 grip inner perimeter 46 to help secure plug 20 in core 12. Other fasteners are possible. For example, barbless plugs may be pressed into a core with an interference fit so that the plug fits securely in the end of the core. While it may be possible to plug core 12 with a plugging part 34 alone, a perimeter flange 30 covering the end of the core usually may be desirable to help control the depth of part 34 during assembly and to help strengthen plug 20. Also in this example, plug 20 includes a shroud 50 surrounding plugging part 30 and spaced apart from the outer perimeter 44 of part 34 a distance nominally equal to a thickness of core 12 at edge 32. A shroud 50 may be desirable to help secure plug 20 in core 12—shroud 50 prevents the end of core 12 from expanding when plug 20 is pushed into the core, enabling a stronger interference fit and greater barb penetration. Also, a shroud 50 can provide a more precise surface to interface to insert into a receiver on the printer.

Continuing to refer to FIGS. 1-5, plug 20 includes a mechanical keying feature 52 and an electrical contact 54. Keying feature 52 discriminates a container 10 from other containers to prevent a container being inserted incorrectly into the receiver (where it connects to the printer's fluid delivery components). In the example shown, keying feature 52 includes three T shaped keys projecting from floor 38 to fit into corresponding keyways on a receiver. The shape, size, number and/or spacing of keys 52 may be varied to distinguish containers, for example to distinguish between containers of different color ink. Other suitable keying features are possible. Electrical contact 54 allows the printer to connect to an integrated circuit chip or other electronic device on container 10. Key 52 and contact 54 are both located within recess 36 behind the plane 42 of flange 30.

Ribs 56 may be used to help minimize deflection in wall 40 while increasing the interference force between plug 20 and core 12. Openings 58 in wall 40 serve as mold conduits to facilitate injection molding the plugs and may provide lock points for receiving mating features on a receiver on the printer.

Referring now specifically to FIG. 2, end cap 16 may fit into or over core 12, or both into and over core 12 as shown in FIG. 2. End cap 16 in FIG. 2 may be characterized as having a flange 60 covering the edge 62 of the end 18 of core 12, a cover 64 covering the open part of core end 18, an insert 66, and a shroud 68 surrounding insert 66. Cap 16 may be pressed into and/or onto end 18 of core 12 with a slight interference fit. Barbs may be used to help secure cap 16 on the end of core 12, if desired, as described above for plug 20.

Figure 6:
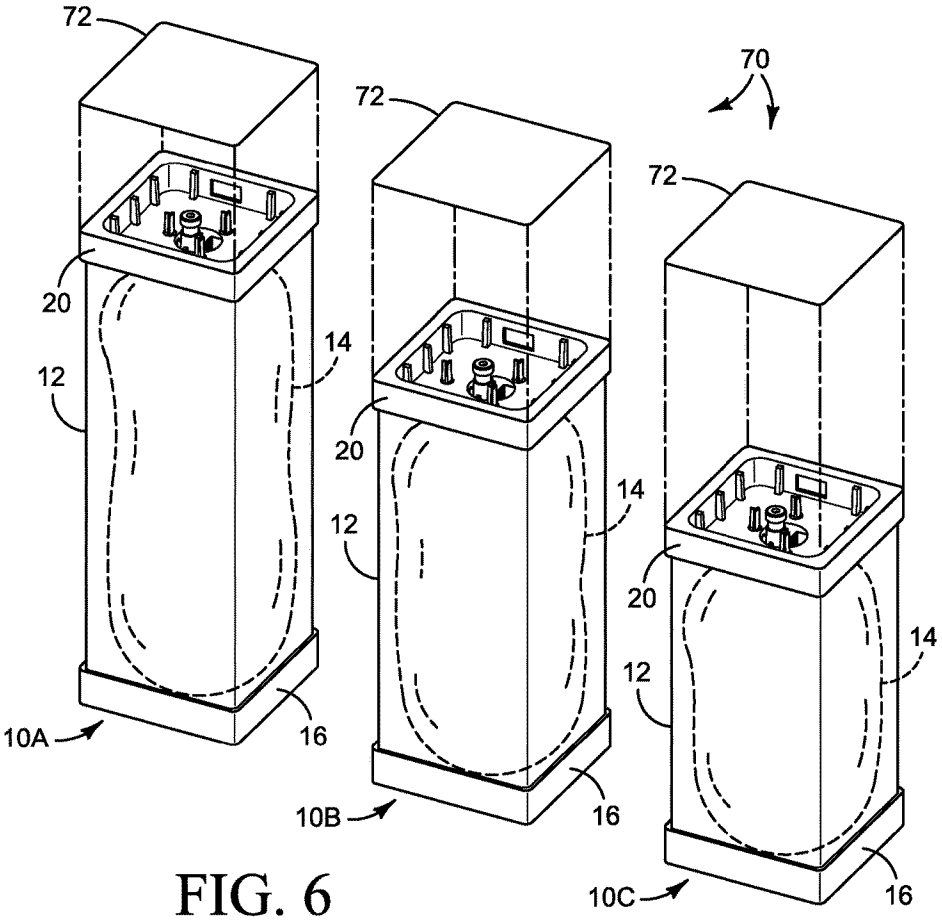
FIGS. 6 and 7 are isometrics illustrating examples of a group of different capacity containers with the same footprint.

FIG. 6 illustrates one example of a group 70 of printing fluid containers having different capacities but the same footprint. Referring to FIG. 6, in this example group 70 includes three containers 10A, 10B, and 10C. Each container 10A-10C is configured as described above with reference to FIGS. 1-5, with each tubular core 12 in group 70 being identical to all of the other cores 12 in the group except that each core is a different length. The footprint 72 of each container 10A, 10B, 10C, defined by the respective plug 20, 20, 20, is identical to the footprint of all of the other plugs. Thus, the footprints of all of the containers 10A-10C in group 70 are identical even though the capacity of the containers is different. (The orientation of containers 10A-10C in FIG. 6 is arbitrary and may not represent the orientation of the containers when installed in a printer.)

Figure 7:
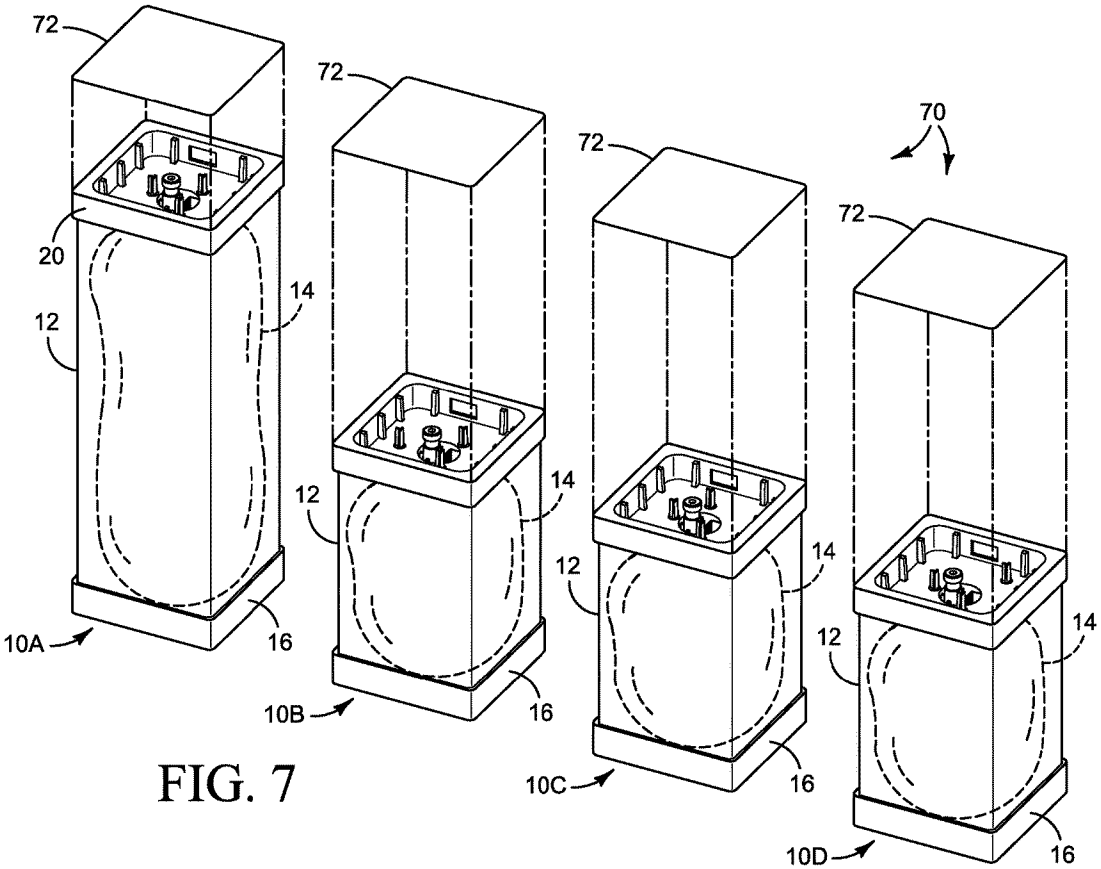

FIG. 7 illustrates another example of a group 70 of printing fluid containers in which some of the containers in the group having different capacities but all of the containers have the same footprint. Referring to FIG. 7, in this example group 70 includes four containers 10A, 10B, 10C and 10D. Each container 10A-10D is configured as described above with reference to FIGS. 1-5, with each tubular core 12 in group 70 being identical to all of the other cores 12 in the group except that the core of container 10A is longer than the core of containers 10B-10D. The larger capacity container 10A, for example, may hold black (K) ink and the smaller capacity containers 10B, 10C and 10D may hold cyan (C), magenta (M) and yellow (Y) ink. The footprint 72 of each container 10A-10D, defined by the respective plug 20, is identical to the footprint of all of the other plugs. Thus, the footprints of all of the containers 10A-10D in group 70 are identical even though the capacity of the containers is different. (The orientation of containers 10A-10D in FIG. 7 is arbitrary and may not represent the orientation of the containers when installed in a printer.)

Figure 8:
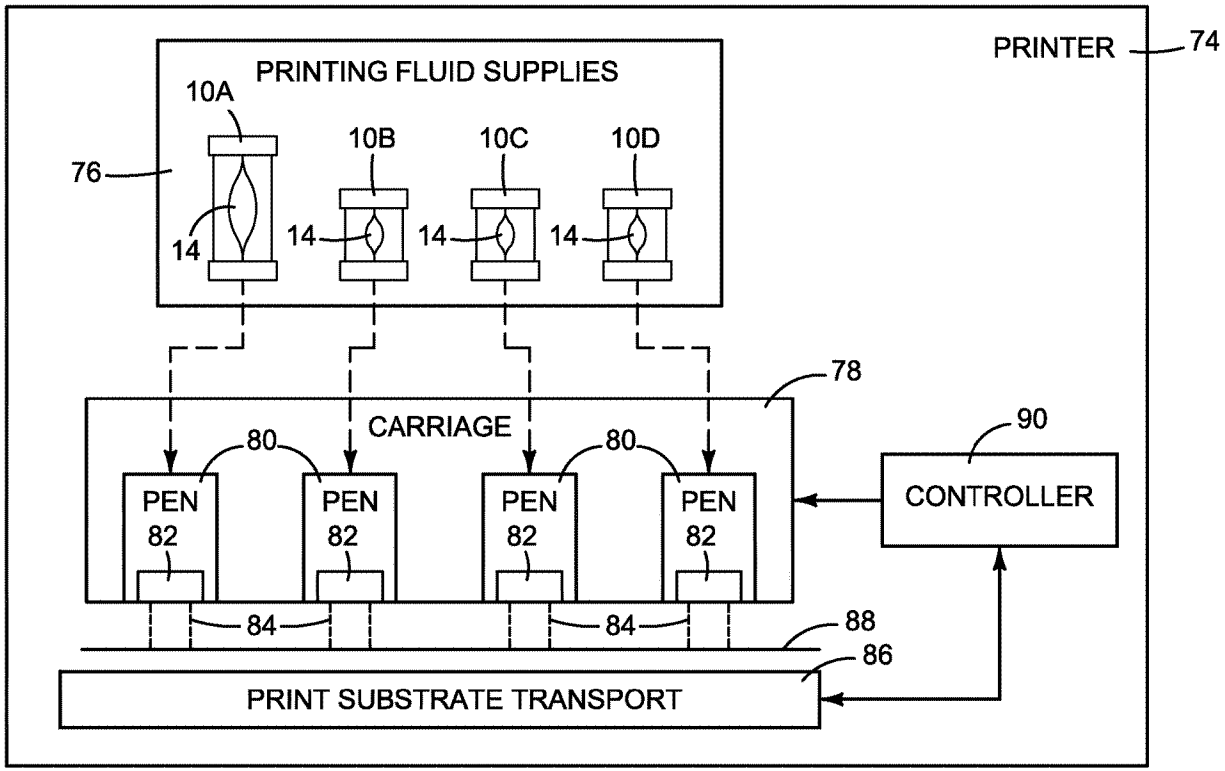
FIG. 8 is a block diagram illustrating an inkjet printer implementing one example of an ink supply station with containers from FIG. 7.
Figure 10:
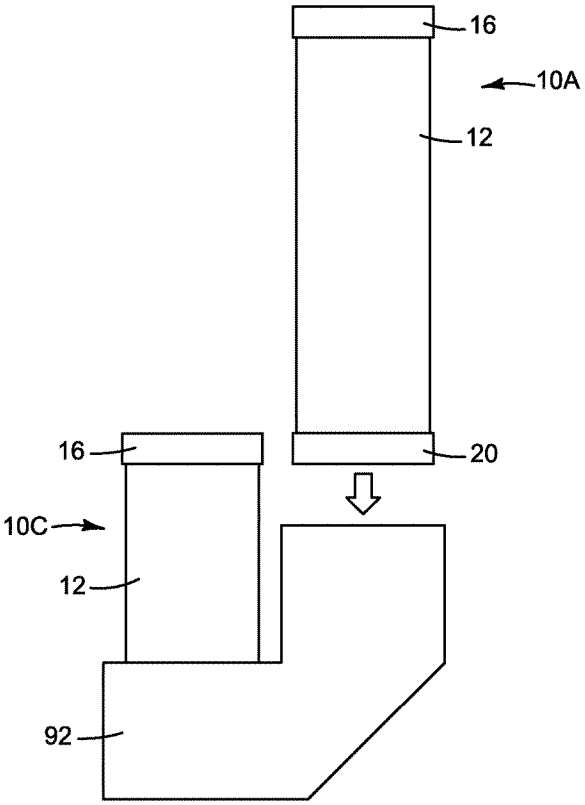
FIGS. 9 and 10 are isometrics illustrating an example ink supply station with containers from FIG. 7, such as might be used in the printer shown in FIG. 8.
Figure 9:
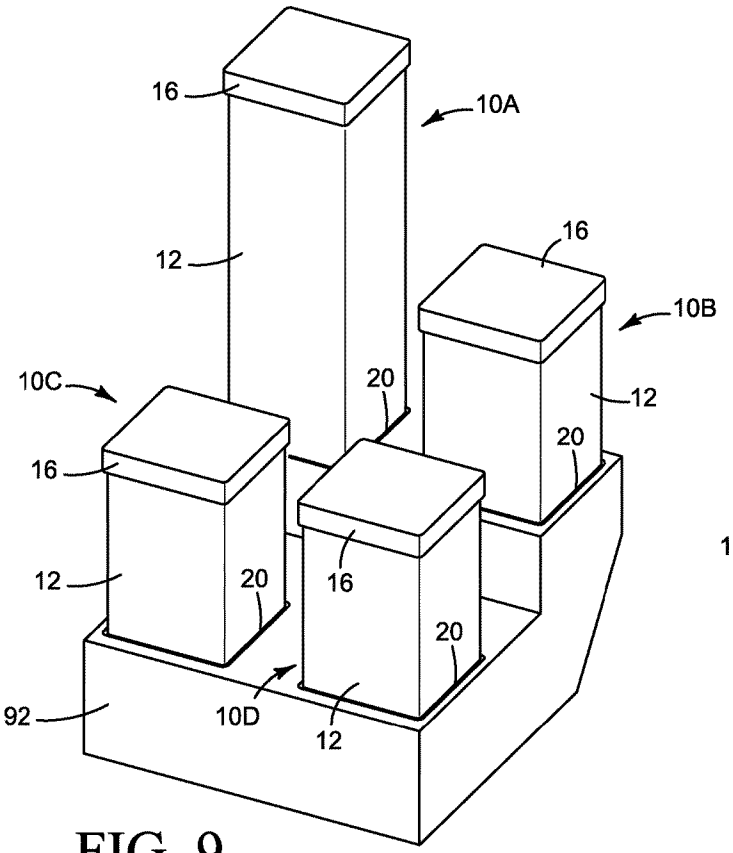

FIG. 8 is a block diagram illustrating an inkjet printer 74 implementing one example of an ink supply station 76 with containers 10A-10D from FIG. 7. FIGS. 9 and 10 are isometrics illustrating an example ink supply station 76 with containers 10A-10D from FIG. 7, such as might be used in printer 10 shown in FIG. 8. Referring first to FIG. 8, printer 74 includes a carriage 78 carrying multiple ink pens 80 connected to ink containers 10A-10D. Inkjet ink pens 80 are also commonly referred to as ink cartridges or print cartridges and may dispense ink and other printing fluids from a printhead or multiple printheads 82 contained within each pen 80, for example as drops or streams 84. A transport mechanism 86 advances a paper or other print substrate 88 past carriage 78 and pens 80. A controller 90 is operatively connected to carriage 78, printheads 82 and substrate transport 86. Controller 90 represents the programming, processors and associated memory, and the electronic circuitry and components needed to control the operative elements of printer 74.

Referring now to FIGS. 9 and 10, in this example, ink supply station 76 includes a receiver 92 to receive ink containers 10A-10D. A receiver 92 may be configured, for example, as a single unit with individual stalls for each container or as a group of discrete units each to receive a single container. Receiver 92 includes inlets to receive ink through container ports 24 (FIGS. 1-3) and, if applicable, a keying feature to receive the corresponding container keying feature 52 (FIGS. 1-3).

Figure 11:
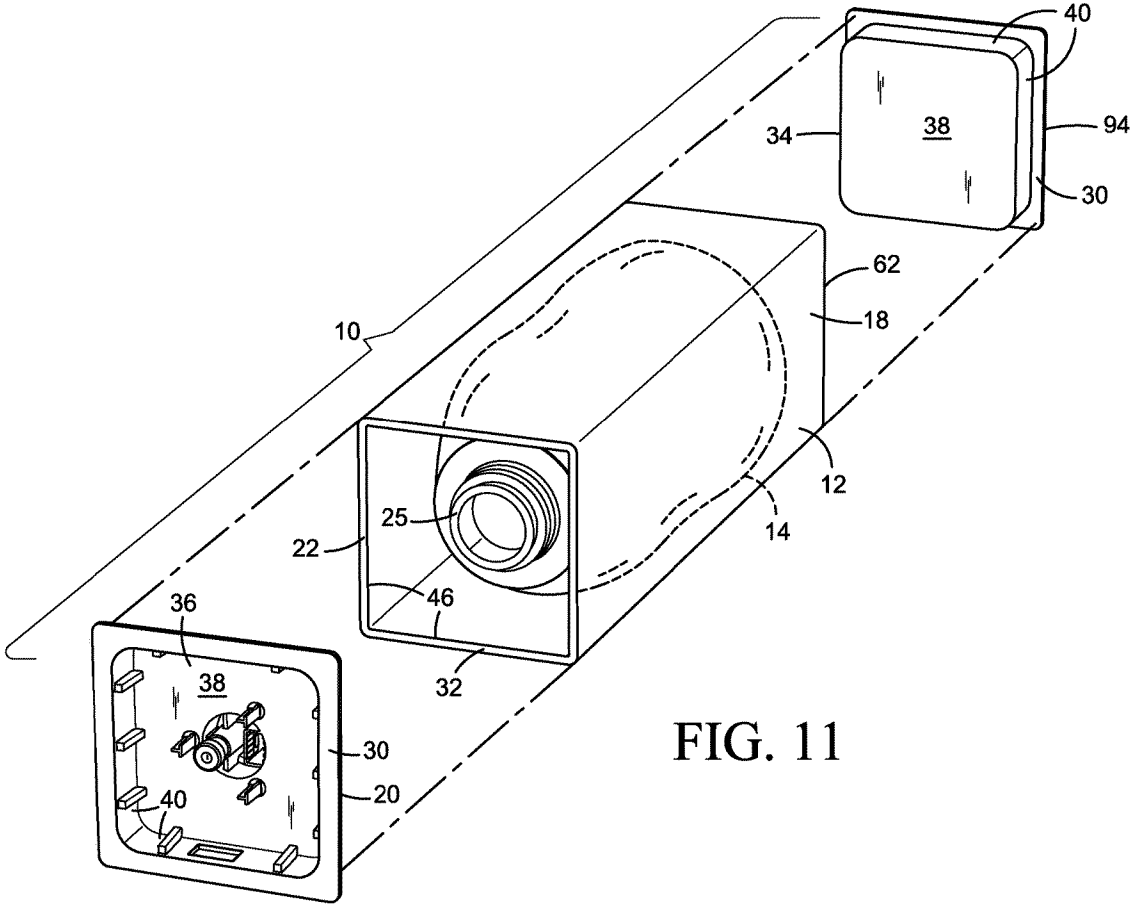
FIG. 11 is an exploded isometric illustrating another example of a container to hold ink or other printing fluid.
Figure 12:
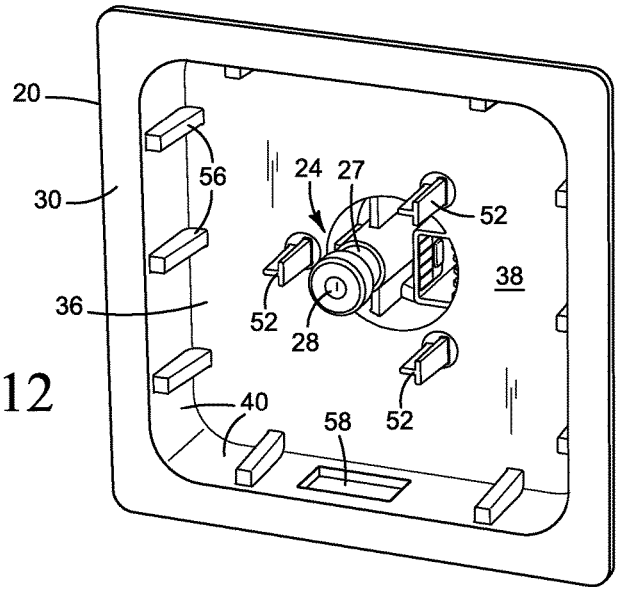
FIGS. 12 and 13 are front side and back side isometrics, respectively, illustrating one example of an end plug in the container shown in FIGS. 1 and 2.
Figure 13:
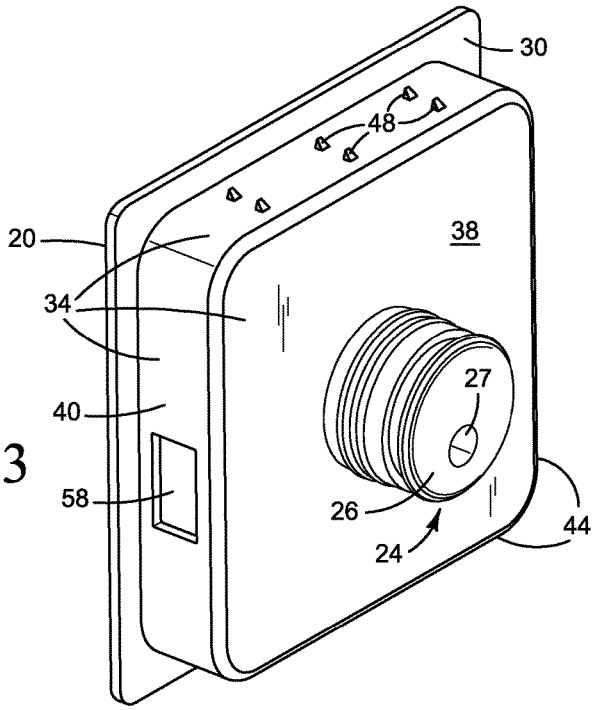

FIGS. 11-13 illustrate another example of a container 10, in which both ends of core 12 are plugged. Referring to FIGS. 11-13, a plug 94 plugs one end 18 of core 12 and a plug 20 plugs the other end 22 of core 12. Also in this example, wall 40 is unshrouded.

Molded plastic plugs 20 and caps 16 (or plugs 94) with fiberboard cores 12 may be used to help reduce cost. The capacity of a container 10 may be changed by varying the length of core 12 and bag 14 without changing either plug 20 or cap 16 and plug 94. Thus, a container 10 may be scaled up or down while maintaining a constant footprint at the printer interface.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means at least one.

The invention claimed is:

1. A printing fluid container insertable into and removable from a receiver, the container comprising:

a fiberboard tube;

a molded plastic cap capping a first end of the tube or a molded plastic plug plugging the first end of the tube; and a molded plastic interface plug plugging a second end of the tube opposite the first end, the interface plug including:

a flange covering an edge of the second end of the tube;

a part protruding from the flange into and plugging the second end of the tube; and multiple barbs along an outer perimeter of the protruding part to grip an inside of the second end of the tube;

a conduit molded into the interface plug to connect the inside of the tube to the receiver when the container is inserted into the receiver; and a keying feature molded into the interface plug to discriminate the container from other containers when inserted into the receiver.

2. The container of claim 1, comprising a bag in the tube to hold a printing fluid and where the conduit is operatively connected to an outlet from the bag such that printing fluid can flow out of the bag and through the conduit.

3. A group of ink containers, each container including:

a rigid fiberboard tube defining an interior volume to contain a bag of ink, each tube in the group being identical to all of the other tubes in the group except that not all of the tubes are the same length, and each tube having a first open end and a second open end opposite the first open end;

a molded plastic cap capping the first open end of the tube or a molded plastic plug plugging the first open end of the tube;

a molded plastic interface plug plugging the second open end of the tube, the interface plug including:

a flange covering an edge of the second open end of the tube;

a part protruding from the flange into and plugging the second open end of the tube; and one or both of a shroud surrounding the protruding part and spaced apart from the protruding part a distance nominally equal to a thickness of the edge of the second open end of the tube or multiple barbs along an outer perimeter of the protruding part to grip an inside of the second open end of the tube;

a conduit molded into the interface plug to connect the inside of the tube to the receiver when the container is inserted into the receiver;

a keying feature molded into the interface plug to discriminate the container from other containers in the group when inserted into the receiver; and where each interface plug in the group has a footprint identical to all of the other interface plugs in the group.

4. The group of claim 3, where each container includes:

a bag of ink in the interior volume of the tube; and an outlet from the bag connected to the conduit in the interface plug.

5. The group of claim 4, where:

one of the bags holds black ink;

one of the bags holds cyan ink;

one of the bags holds magenta ink;

one of the bags holds yellow ink; and the tube for the black ink container is longer than the tube for the cyan, magenta and yellow ink containers.

6. A printing fluid container insertable into and removable from a receiver, the container comprising:

a fiberboard tube having a first open end and a second open end opposite the first open end;

a molded plastic cap capping the first open end of the tube or a molded plastic plug plugging the first open end of the tube, without an air seal; and a molded plastic interface plug plugging the second open end of the tube, the interface plug including:

a flange covering an edge of the second open end of the tube;

a part protruding from the flange into and plugging the second open end of the tube; and a shroud surrounding the protruding part and spaced apart from the protruding part a distance nominally equal to a thickness of the edge of the second open end of the tube;

a conduit molded into the interface plug to connect the inside of the tube to the receiver when the container is inserted into the receiver; and a keying feature molded into the interface plug to discriminate the container from other containers when inserted into the receiver.

7. The container of claim 6, comprising a bag in the tube to hold a printing fluid and where the conduit is operatively connected to an outlet from the bag such that printing fluid can flow out of the bag and through the conduit.

8. The container of claim 7, where the interface plug includes a floor and a wall extending from the floor to the flange, the floor and wall defining a plugging part on a first side of the interface plug and a recess on a second side of the interface plug opposite the first side, and the conduit and the keying feature do not protrude from the recess.

* * * * *